US005583395A

United States Patent [19]

Lu

[11] Patent Number: 5,583,395

[45] Date of Patent: Dec. 10, 1996

[54] FLUORESCENT DEVICE HAVING A FLUORESCENT STARTER WHICH PRECISELY CONTROLS HEATING TIME AND ABSOLUTE SYNCHRONISM OF FIRE POINT

[76] Inventor: Chao-Cheng Lu, 4-4, Alley 27, Lane 143, Chun Kung Rd., Taipei, Taiwan, 11614

[21] Appl. No.: 320,536

[22] Filed: Oct. 11, 1994

[51] Int. Cl.[6] ..... H05B 39/00

[52] U.S. Cl. ..... 315/94; 315/101; 315/105; 315/208; 315/DIG. 5

[58] Field of Search ..... 315/94, 97, 101, 315/105, 106, 308, DIG. 2, DIG. 5, 200 R, 207, 208, 239

[56] References Cited

U.S. PATENT DOCUMENTS 3,919,590 11/1975 Remery et al. ..... 315/101
4,145,638 3/1979 Kaneda ..... 315/101 X
4,165,475 8/1979 Pegg et al. ..... 315/101 X
4,177,403 12/1979 Remery ..... 315/101
5,010,274 4/1991 Phillips et al. ..... 315/101
5,111,115 5/1992 Ball et al. ..... 315/DIG. 5 X
5,440,204 8/1995 Shih ..... 315/94

*Primary Examiner*—Robert Pascal
*Assistant Examiner*—Haissa Philogene
*Attorney, Agent, or Firm*—Jacobson, Price, Holman & Stern, PLLC

[57] ABSTRACT

A new fluorescent device including an electronic fluorescent starter, a phase leading capacitor, a ballast, a bridge rectifier, a fluorescent lamp, a brightness compensation circuit, and a control circuit, the electronic fluorescent starter consisting of a master switch circuit, an ignition circuit and a time control circuit, wherein the electronic fluorescent starter matches with the ballast to turn on the fluorescent lamp; the control circuit turns the electronic fluorescent starter to the open circuit state when the fluorescent lamp is turned on; the brightness compensation circuit improves the intensity of light from the fluorescent lamp.

11 Claims, 8 Drawing Sheets

FLUORESCENT DEVICE HAVING A FLUORESCENT STARTER WHICH PRECISELY CONTROLS HEATING TIME AND ABSOLUTE SYNCHRONISM OF FIRE POINT

BACKGROUND OF THE INVENTION

1. Field of the Invention

The present invention relates to fluorescent lamps, and relates more particularly to an electronic fluorescent starter which precisely controls heating time and absolute synchronism of fire point to achieve instant ignition and to save power consumption.

2. Description of the Prior Art

According to conventional electronic fluorescent starters, the principle of heating is to set one half cycle of AC power supply to store electric energy for starting the other half cycle, and the principle of ignition is to use resistance and capacitance as a time base on time for constant ignition. Therefore, conventional electronic fluorescent starters commonly use resistance and capacitance as the time constant value during heating, ignition, as well as lighting of the lamp. However, the values of resistance and capacitance are not accurate, it is difficult to accurately control heating time and ignition time. Therefore, over-heating and over-ignition problems tend to occur in fluorescent lamps. These problems waste much electric power and shorten the service life of the fluorescent lamps. This is why electronic fluorescent starters are not popular.

SUMMARY OF THE INVENTION

The present invention has been accomplished to provide a new fluorescent device which eliminates the aforesaid problems. It is the major object of the present invention to provide a fluorescent device which improves the heating and ignition process of a fluorescent lamp so as to prolong its service life and performance. According to the present invention, when the fluorescent lamp is turned on, the starter circuit is turned to the open-circuit state by the control circuit, and therefore the starter does not consume electric power when the ignition process of the fluorescent lamp is done. The fluorescent device comprises a full wave bridge rectifier circuit, which provides both terminals of the fluorescent lamp with −120 Hz full wave voltage at both terminals so that the flashing problem of the fluorescent lamp is eliminated, a ballast, which produces a stable high voltage during the ignition of the fluorescent lamp to keep the fluorescent lamp lighting stably, a phase leading capacitor, which enables the fluorescent device to obtain a high power factor value, a brightness compensation circuit, which when the voltage from the AC power supply is insufficient, improves the brightness of the fluorescent lamp by increasing the pulse voltage. The fluorescent device of the present invention further comprises a master switch circuit, which is patented under Chinese pat. no. 64,244, and a time control circuit, which has been disclosed in an allowed Chinese patent application Ser. No. 82,110,012.

DETAILED DESCRIPTION OF THE PREFERRED EMBODIMENT

Figure 1:
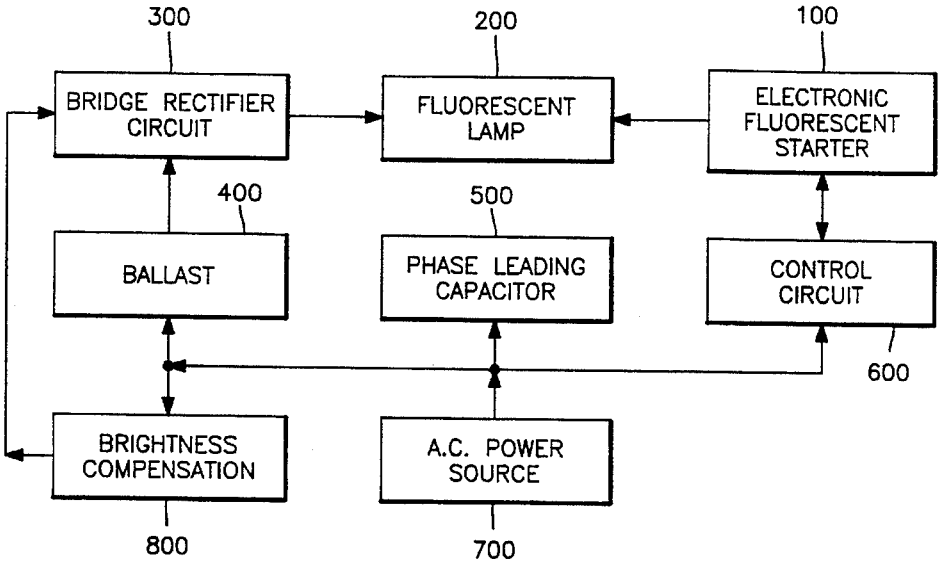
FIG. 1 is a block diagram showing the composition of a fluorescent device according to the present invention.

Referring to FIG. 1, a fluorescent device in accordance with the present invention is generally comprised of an electronic fluorescent starter 100, a fluorescent lamp 200, a bridge rectifier circuit 300, a ballast 400, a phase leading capacitor 500, a control circuit 600, an AC power source 700, and a bright compensation circuit 800.

Figure 2:
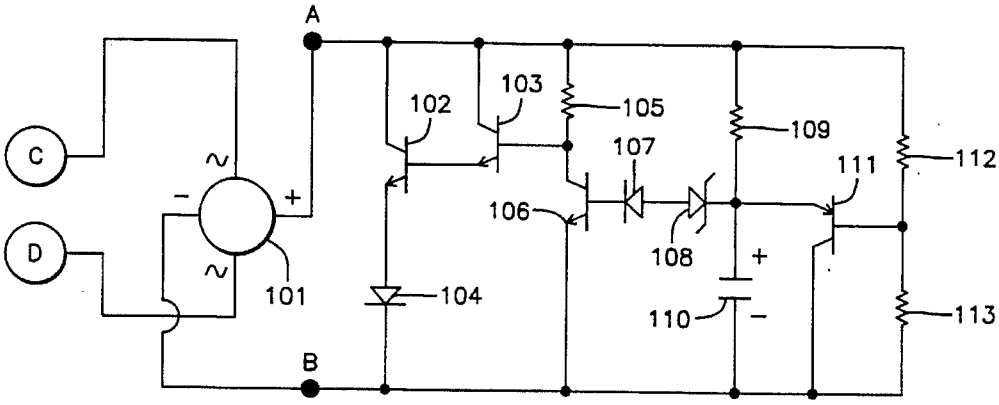
FIG. 2 is a circuit diagram of an electronic fluorescent starter according to the present invention.

Referring to FIG. 2, the electronic fluorescent starter 100 comprises a master switch circuit consisting of a bridge rectifier 101, darlington circuits 102 and 103, a diode 104 and a resistor 105, an ignition circuit consisting of a transistor 106, a diode 107, and a zener diode 108, a time control circuit consisting of a time constant resistor 109, a time constant capacitor 110, a transistor 111 and two shunt resistors 112 and 113. When the two opposite terminals of the fluorescent lamp 200 give output voltage to the two opposite terminals CD, it is rectified through the bridge rectifier 101. Therefore, the voltage at the terminal A is a positive voltage, and the voltage at the terminal B is a negative voltage. The positive voltage from the terminal A is sent through the resistor 105 at the base of the transistor 103 to electrically connect the darlington circuits 102 and 103. At the same time, the electric current from the terminal A is sent through the collector and emitter of the transistor 102 to the P junction of the diode 104 then to its N junction, and then sent to the terminal B to heat the tungsten filaments 201 and 202 of the fluorescent lamp 200. When the tungsten filaments 201 and 202 are heated, the voltage from the terminal A is simultaneously sent through the time constant resistor 109 to charge the time constant capacitor 110. The voltage charging rate at the two opposite terminals of the time constant capacitor 110 is determined subject to the values of the time constant resistor 109 and the time constant capacitor 110. When the voltage at the two opposite terminals of the time constant capacitor 110 surpasses the zener voltage of the zener diode 108, a big current is sent through the diode 107 to the base of the transistor 106 to drive the transistor 106 into the saturation state, causing the darlington circuits 102 and 103 to switch to the open-circuit state. When the darlington circuits 102 and 103 are switched to the open-circuit state, the ballast 400 produces a high voltage e=−L di/dt which is sent through the bridge rectifier circuit 300 to ignite the fluorescent lamp 200 until the fluorescent lamp 200 is turned on to give light. When the AC power source is turned off, the voltage at both of its terminals A and B is zeroed, and therefore the transistor 111 discharges the voltage of the time constant capacitor 110 to reset the time control for a subsequent counting operation. The shunt resistors 112 and 113 are provided to control the sensitivity of the transistor 111.

Figure 3:
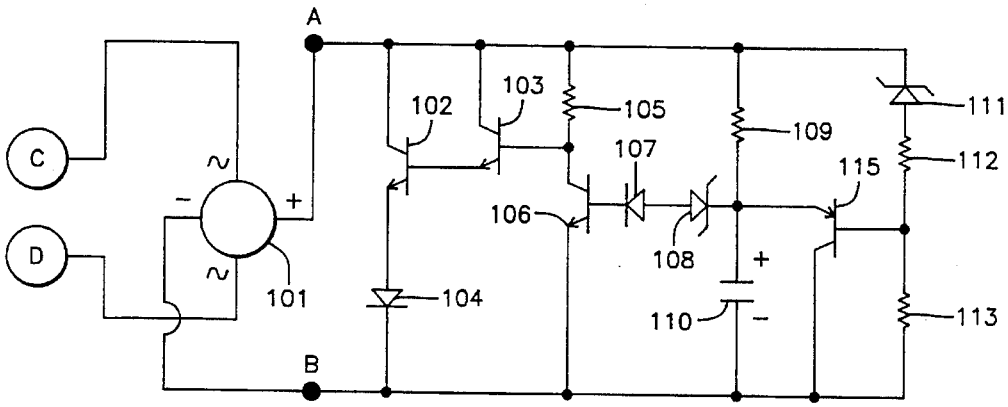
FIG. 3 is a circuit diagram of an alternate form of the electronic fluorescent starter of the present invention.
Figure 4A:
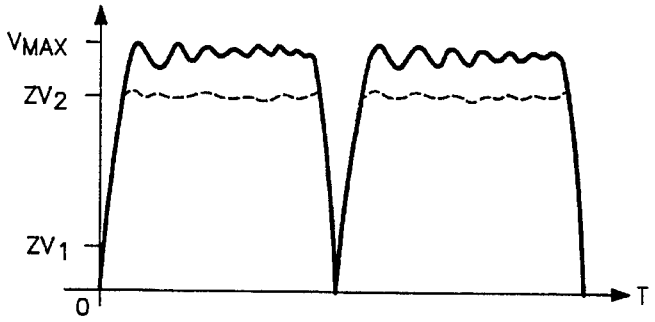
FIGS. 4A and 4B are voltage wave diagrams showing the ignition operation of the circuit of FIG. 3.
Figure 4B:
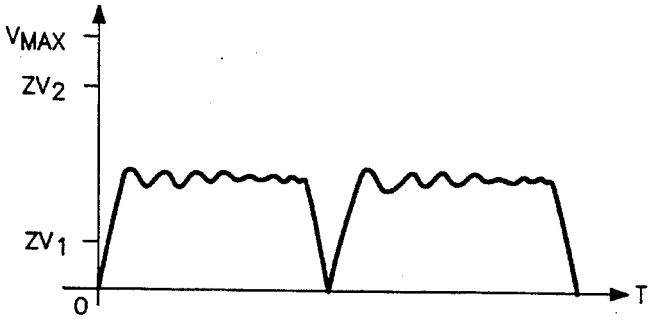

FIGS. 3 and 4 show an alternate form of the electronic fluorescent starter. The different points of this alternate form are shown in FIGS. 4A and 4B. When the full wave voltage at the terminal A reaches the zener voltage of the zener diode 108, the fluorescent lamp 200 starts to ignite, as the voltage waveform shown in FIGS. 4A and 4B corresponding to the coordinate ZV1; VMAX is the coordinate of the voltage waveform when the fluorescent lamp 200 does not do the ignition work. When the voltage at the terminal A is gradually increased to the zener voltage of the zener diode 108, the voltage waveform is shown in FIGS. 4A and 4B corresponding to the coordinate ZV2, and the transistor 115 starts to zero the voltage at the two opposite ends of the time constant capacitor 110. When the voltage at the terminal A drops to the zener voltage of the zener diode 108, the fluorescent lamp 200 also starts to ignite. The aforesaid procedure is repeated again and again until the fluorescent lamp 200 is turned on to give light. Either structure of the fluorescent starter 100 shown in FIG. 2 or FIG. 3 may be used in the fluorescent device of the present invention as desired, without affecting the performance of the present invention. FIG. 4A shows the waveform of the voltage at the terminal A during the ignition process; FIG. 4B shows the waveform of the voltage at the terminal A after lighting of the fluorescent lamp 200 occurs. When the voltage at the terminal A becomes lower than that of ZV2, it means that the fluorescent lamp 200 has been turned on to give light.

Figure 5:
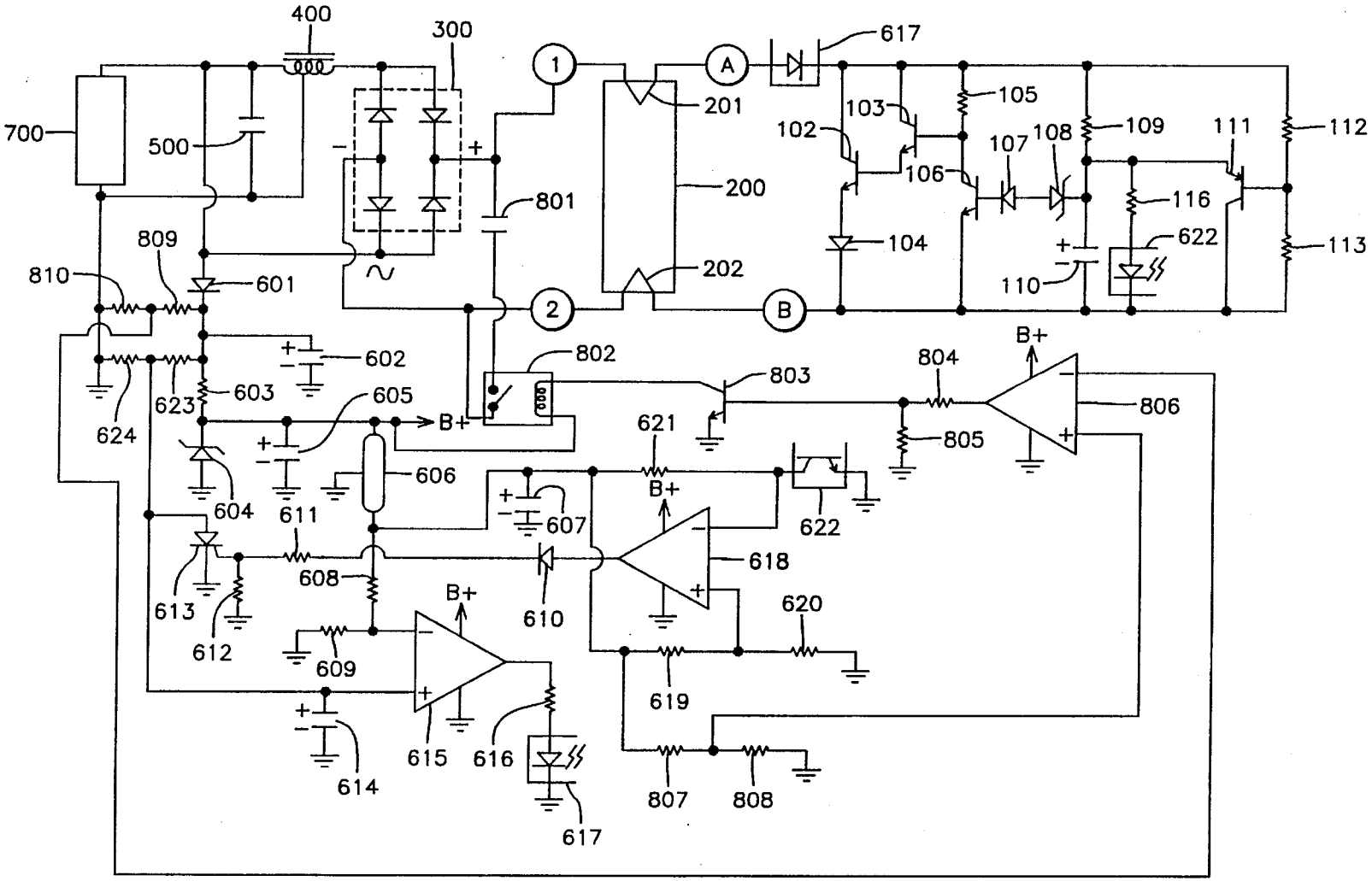
FIG. 5 is a circuit diagram of the fluorescent device of the present invention.

Referring to FIG. 5, when one end of the AC power source 700 is corrected to the half-wave rectifier diode 601, a half-wave rectified voltage is obtained at the voltage drop resistor 603 and the filter capacitor 602, which half-wave rectified voltage is then sent to the positive terminals of the zener diode 604, the filter capacitor 605, the three-terminal voltage regulator 606 and the OP AMP IC 615 and 618. Because of the effect of the filter capacitors 602 and 605, a steady DC voltage is obtained from the output terminal of the three-terminal voltage regulator 606. The steady DC voltage is then sent to the shunt resistors 608 and 609 to provide a steady reference voltage to the negative input terminal of the first OP AMP IC 615, and also to provide a steady reference voltage to the negative input terminal of the second OP AMP IC 618 through the shunt resistor 621 via the photo coupler 622. At the same time, the DC voltage is sent through the shunt resistors 619 and 620 to provide a steady reference voltage to the positive input terminal of the second OP AMP IC 618. The input voltage of the positive input terminal of the first OP AMP IC 615 is obtained from the node between the shunt resistors 623 and 624. The filter capacitor 614 converts the voltage at the node between the shunt resistors 623 and 624 into a DC voltage. When the voltage of the AC power source rises from a zero voltage, the DC voltage at the node between the shunt resistors 623 and 624 increases relatively. When the voltage at the negative input terminal of the first OP AMP IC 615 surpasses that at its positive input terminal, the output terminal of the first OP AMP IC 615 gives no output. When the voltage at the positive input terminal of the first OP AMP IC 615 surpasses that at its negative input terminal, a positive voltage is obtained from the output terminal of the first OP AMP IC 615. The positive voltage from the output terminal of the first OP AMP IC 615 is sent through the voltage drop resistor 616 to the LED (light emitting diode) at the photo thyristor coupler 617, causing the output terminal of the photo thyristor coupler 617 to be electrically connected to heat the tungsten filaments and ignite the fluorescent lamp 200. When the fluorescent lamp 200 is turned on, the LED at the input terminal of the photo coupler 622 is turned on to give light. The voltage which turns on the LED at the input terminal of the photo coupler 622 is obtained from the voltage at the two opposite ends of the time constant capacitor 110 and dropped through the voltage drop resistor 116. Therefore, the output voltage of the photo coupler 622 is about 0.4 V. At the same time, the voltage at the positive input terminal of the second OP AMP IC 618 surpasses its negative input terminal, therefore the output terminal of the second OP AMP IC 618 gives a positive voltage, which is sent through the diode 610 and the voltage drop resistor 611 to the gate of the silicon controlled rectifier 613, causing the silicon controlled rectifier 613 to become electrically conductive. When the silicon controlled rectifier 613 is turned on, the voltage at the positive input terminal of the first OP AMP IC 615 is below its negative input terminal; therefore the gate of the photo thyristor coupler 617 is off, and the electronic fluorescent starter 100 is off, i.e., when the fluorescent lamp 200 is turned on to give light, the electronic fluorescent starter 100 is off. When the two opposite terminals of the AC power source 700 are electrically connected to the phase leading capacitor 500, a high power factor value is obtained, at the same time, the AC power source 700 is connected to the two opposite ends of the low voltage side of the ballast 400, and the high voltage side of the ballast 400 is connected to the AC terminal of the bridge rectifier circuit 300, causing the positive terminal of the bridge rectifier circuit 300 to provide a 120 HZ full wave rectifier voltage, and therefore flashing of the fluorescent lamp 200 is minimized.

Figure 6A:
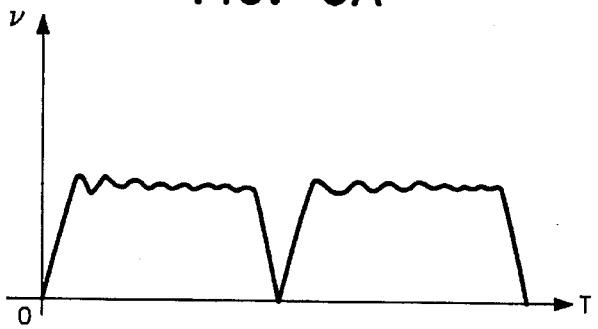
FIGS. 6A and 6B are a voltage wave diagrams of the brightness compensation circuit of the fluorescent device shown in FIG. 5.
Figure 6B:
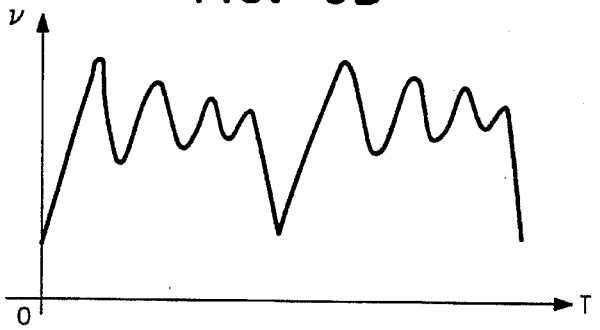

As illustrated in FIG. 5, when the fluorescent lamp 200 is turned on, the voltage waveform shown in FIG. 6A appears at the 1 and 2 terminals of the fluorescent lamp 200. If the AC voltage is at a level far below the rated voltage, the intensity of light of the fluorescent lamp will be weaken. Under this stage, the output terminal of the third OP AMP IC 806 gives an output voltage through two shunt resistors 804 and 805 to turn on the transistor 803, causing the relay 802 to become electrically connected. At the same time, the high voltage capacitor 801 is connected to the 1 and 2 terminals of the fluorescent lamp 200. The voltage waveform at the fluorescent lamp 200 is shown in FIG. 6B, its DC portion is increased, and the height of its pulse voltage is also relatively increased, and therefore the intensity of light emitted by the fluorescent lamp 200 is increased. By defining the capacitance value of the high voltage capacitor 801 properly, a DC voltage of the waveform and pulse height shown in FIG. 6B can be obtained. When the voltage of the AC power source is increased, the voltage at the node between the shunt resistors 809 and 810 is relatively increased, causing an increase in the voltage at the negative input terminal of the third OP AMP IC 806. When the voltage at the negative input terminal of the third OP AMP IC 806 surpasses its positive input terminal, the third OP AMP IC 806 gives no output, the contact of the relay 802 is switched from the ON state to the OFF state, and the high voltage capacitor 801 and the 1 and 2 terminals of the fluorescent lamp 200 are disconnected. The reference voltage of the positive input terminal of the third OP AMP IC 806 is obtained from the node between the shunt resistors 807 and 808. The two opposite ends of the shunt resistors 807 and 808 are respectively connected to the output terminal of the three-terminal voltage regulator 606 and to ground.

Figure 7:
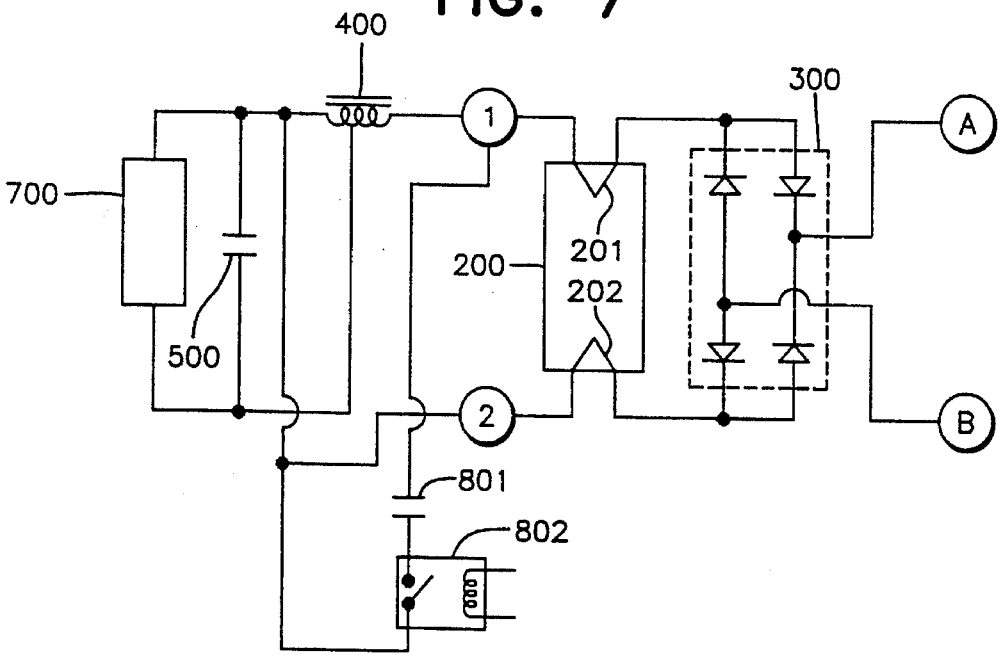
FIG. 7 is a circuit diagram of an AC brightness compensation circuit according to the present invention.
Figure 9A:
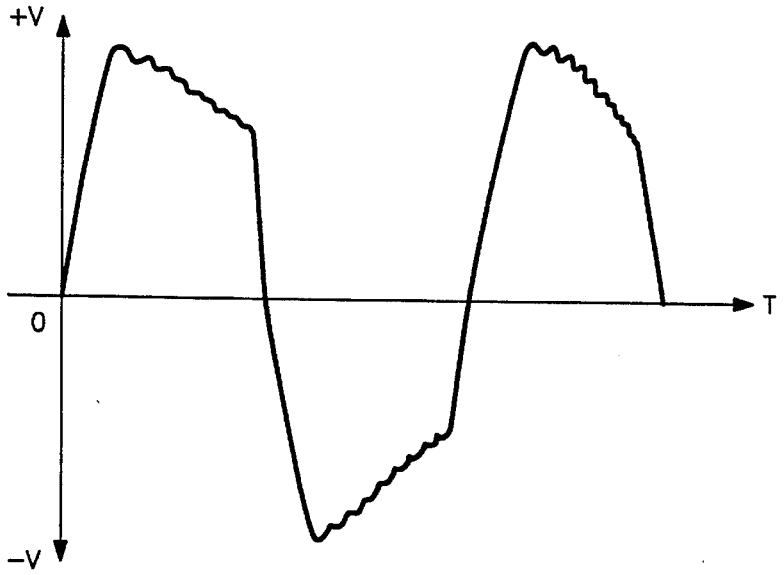
FIGS. 9A and 9B are voltage wave diagrams of the AC brightness compensation circuit of the present invention.
Figure 9B:
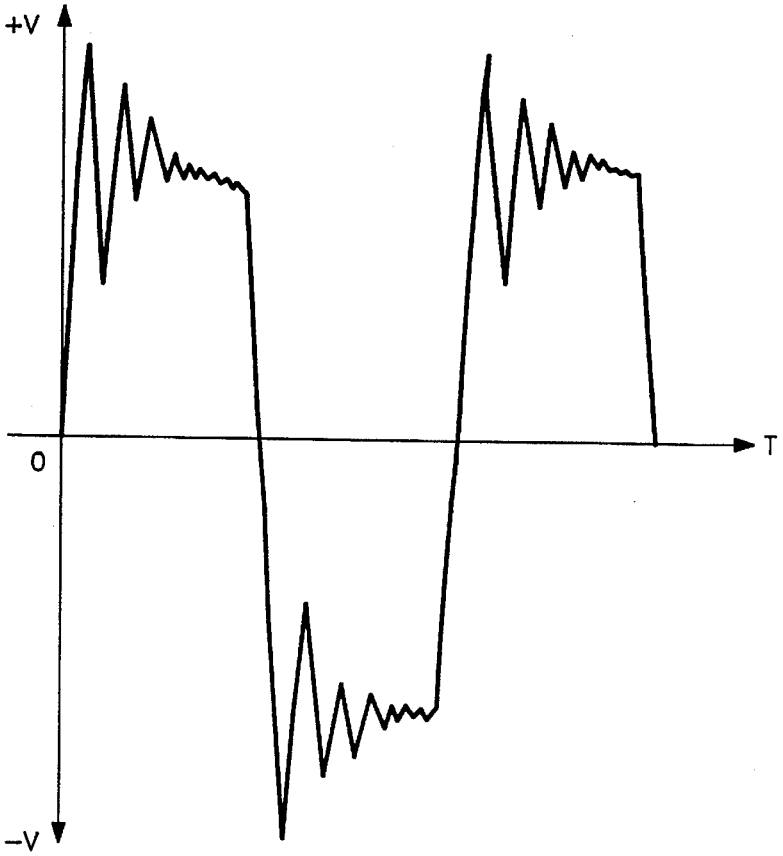

FIG. 7 shows the bridge rectifier circuit 300 shifted to two terminals 201 and 202 of the fluorescent lamp 200, the AC terminal of the bridge rectifier circuit 300 is connected to the two terminals 201 and 202 of the fluorescent lamp 200, the positive and negative terminals of the bridge rectifier circuit 300 are connected to the terminals A and B of the electronic fluorescent starter 100, while at the same time the output terminal of the ballast 400 is connected to the terminals 1 and 2 of the fluorescent lamp 200, and the relay 802 and the high voltage capacitor 801, similar to FIG. 5, are respectively connected to the terminals 1 and 2 of the fluorescent lamp 200. The arrangement of the phase leading capacitor 500, the control circuit 600 and the AC power source 700 is remain unchanged. When the relay 802 of FIG. 7 does no work, the voltage waveform shown in FIG. 9A appears at the terminals 1 and 2 of the fluorescent lamp 200. When the relay 802 works, the two opposite ends of the high voltage capacitor 801 are connected in series to the relay 802 and then to the terminals 201 and 202 of the fluorescent lamp 200, and the voltage waveform is as shown in FIG. 9B, which voltage is sufficient to increase the intensity of light of the fluorescent lamp 200.

Figure 8:
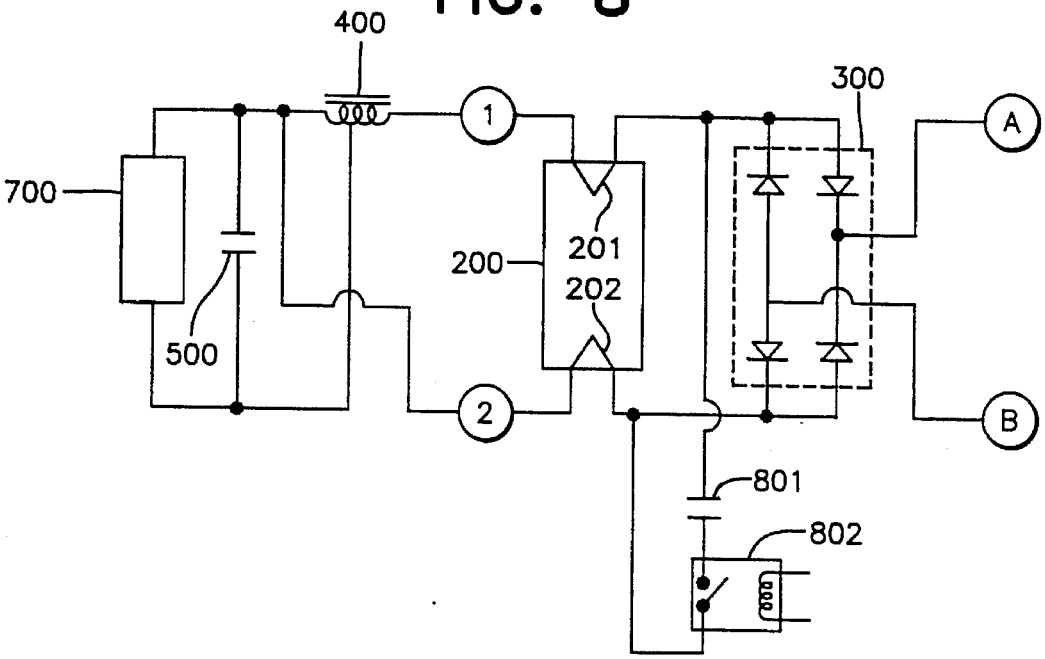
FIG. 8 is another circuit diagram of the AC brightness compensation circuit of the present invention.

FIG. 8 shows the high voltage capacitor 801 and relay 802 of the bridge rectifier circuit 300 and brightness compensation circuit 800 shifted from the terminals 1 and 2 of the fluorescent lamp 200 to the terminals A and B. In FIG. 8, the output terminal of the ballast 400 is connected to the terminals 1 and 2 of the fluorescent lamp 200, and the circuit arrangement of the phase leading capacitor 500 and the control circuit 600 and the AC power source 700 remained unchanged. When the relay 802 of FIG. 8 does no work or works, the waveforms of the voltage at the terminals 1 and 2 of the fluorescent lamp 200 are respectively as shown in FIGS. 9A and 9B, i.e., similar to that in connection with FIG. 7.

Figure 10:
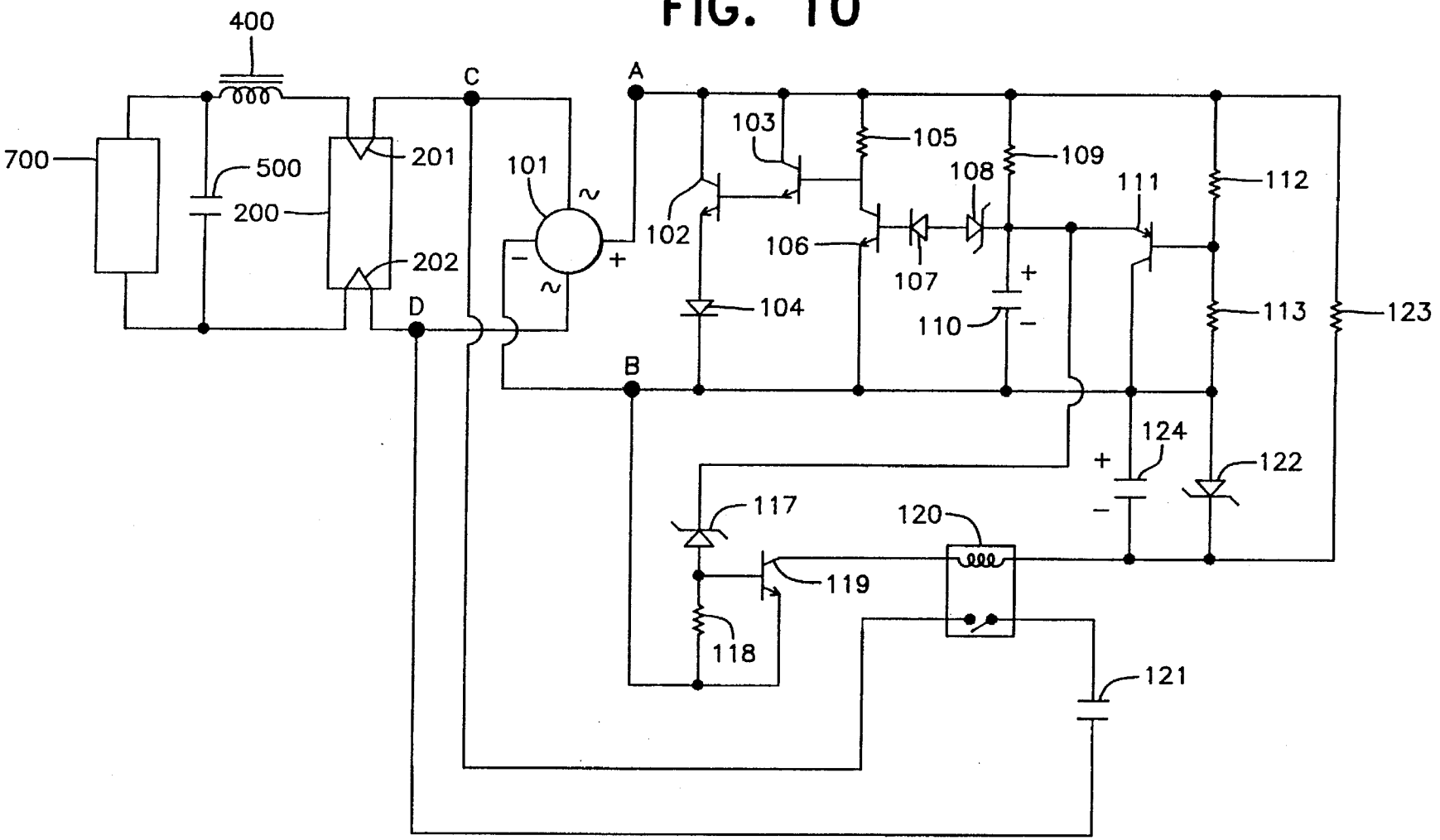
FIG. 10 shows an electronic fluorescent starter having a brightness compensation circuit according to the present invention.

FIG. 10 shows a unitary device in which the electronic fluorescent starter is incorporated with the high voltage capacitor 121, the relay 120, the voltage drop resister 123, the base resistor 118, the transistor 119, the filter capacitor 124, the first zener diode 117 and the second zener diode 122. When AC power source is connected across terminals CD, the terminal A obtains a DC full wave rectified voltage. The voltage at the positive voltage terminal is sent through the time constant resistor 109 to charge the time constant capacitor 110, to further heat and ignite the fluorescent lamp 200, causing the fluorescent lamp 200 to be turned on and give light. When the voltage at the two opposite ends of the time constant capacitor 110 surpasses the zener voltage of the first zener diode 117, the voltage at the two opposite ends of the base resistor 118 switches the base and emitter of the transistor 119 to the saturation state. Under this stage, the collector and emitter of the transistor 119 are turned on, and therefore the coil of the relay 120 receives a DC voltage, causing the contact point of the relay 120 to be switched from normal open to normal closed. At the same time, the high voltage capacitor 121 is connected to both ends of the CD. Therefore, the intensity of light emitted by the fluorescent lamp 200 is increased in the same manner as that shown in FIG. 8. The DC voltage of the relay 120 is obtained from the N junction of the second zener diode 122 and the positive terminal of the filter capacitor 124 and one end of the voltage drop resistor 123. The P junction of the second zener diode 122 and the negative terminal of the filter capacitor 124 are connected to the terminal B. The opposite end of the voltage drop resistor 123 is connected to the terminal A. When the both ends of the CD receive no AC voltage, the voltage at the two opposite ends of the time constant capacitor 110 is zeroed, and therefore the collector and emitter of the transistor 119 are off. Consequently, the contact point of the relay 120 is turned to the normal open state, and therefore the high voltage capacitor 121 is electrically disconnected and the brightness compensation is terminated.

Figure 11:
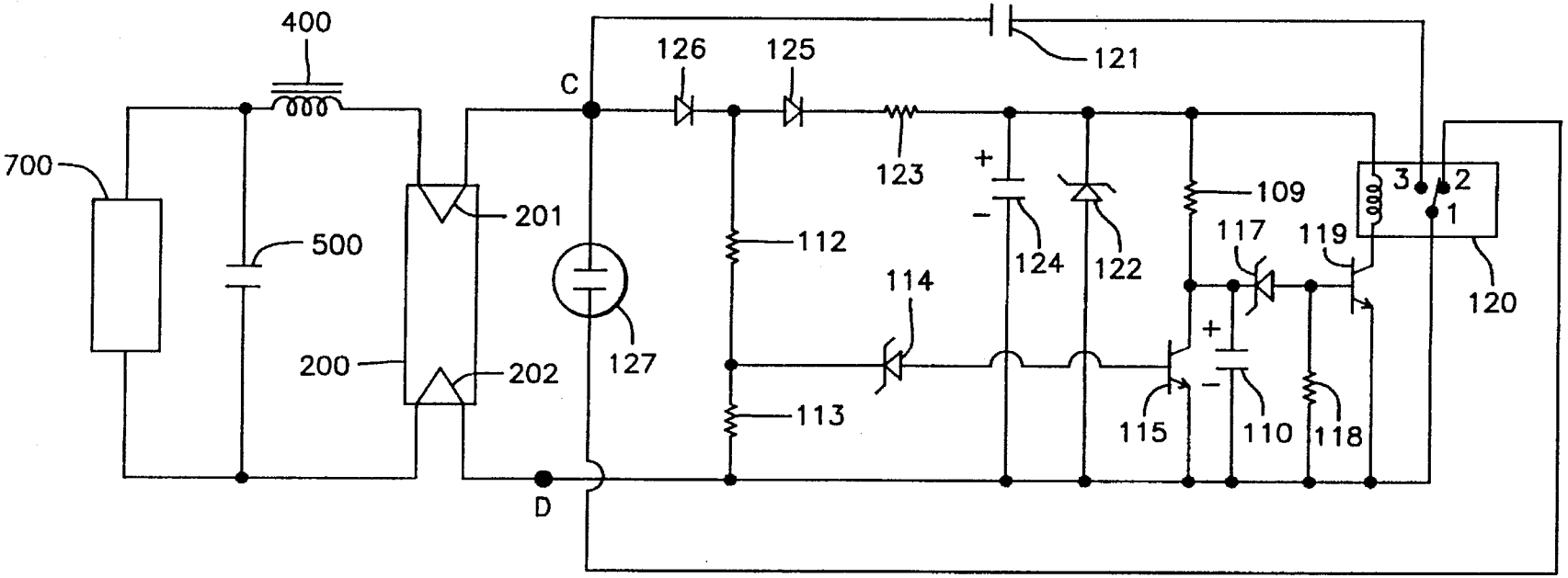
FIG. 11 shows a mechanical fluorescent starter having a brightness compensation circuit according to the present invention.

Referring to FIG. 11, the circuit comprises:

1) the reset voltage circuit of FIG. 3 which consists of the zener diode 114, the shunt resistors 112 and 113 and the transistor 115;

2) the time constant resistor 109 and time constant capacitor 110 of FIG. 2;

3) the brightness compensation circuit of FIG. 10, which consists of the voltage drop resistor 123, the filter capacitor 124, the second zener diode 122, the first zener diode 117, the base resistor 118, the transistor 119, the relay 120 and the high voltage capacitor 121, and a one-way diode 125; and 4) a regular mechanical fluorescent starter 127. When the AC power source has AC voltage, the voltage across both ends of the terminals CD surpasses the ionization point voltage of the fluorescent starter 127, and the fluorescent starter 127 is turned on to heat the fluorescent lamp 200. When the voltage across both ends of the terminals CD drops below the ionization point voltage, the fluorescent starter 127 is turned to the open circuit state, and therefore the fluorescent starter 127 continuously heats and ignites the fluorescent lamp 200, causing it to turn on and give light. When the fluorescent lamp 200 is turned on, the voltage at both ends of the CD drops. When the voltage across both ends of the terminals CD drops, and the time constant resistor 109 and the time constant capacitor 110 start to work. When the voltage at the two opposite ends of the time constant capacitor 110 surpasses the zener voltage of the first zener diode 117, the relay 120 works, causing the high voltage capacitor 121 connected in parallel to the two opposite ends of the terminals CD to increase the intensity of light emitted by the fluorescent lamp 200. Because the relay 120 works at this stage, the fluorescent starter 127 is turned to the open circuit state, and therefore the process of turning on the fluorescent lamp 200 is completed. The contact point of the relay 120 is the contact point C. During the heating and ignition operation of the fluorescent lamp 200, the contact point between 1 and 2 of the relay 120 is On, the contact point between 1 and 3 is OFF. When the fluorescent lamp 200 is turned on to give light, the contact point between 1 and 2 is OFF, and the contact point between 1 and 3 is ON.

Figure 12:
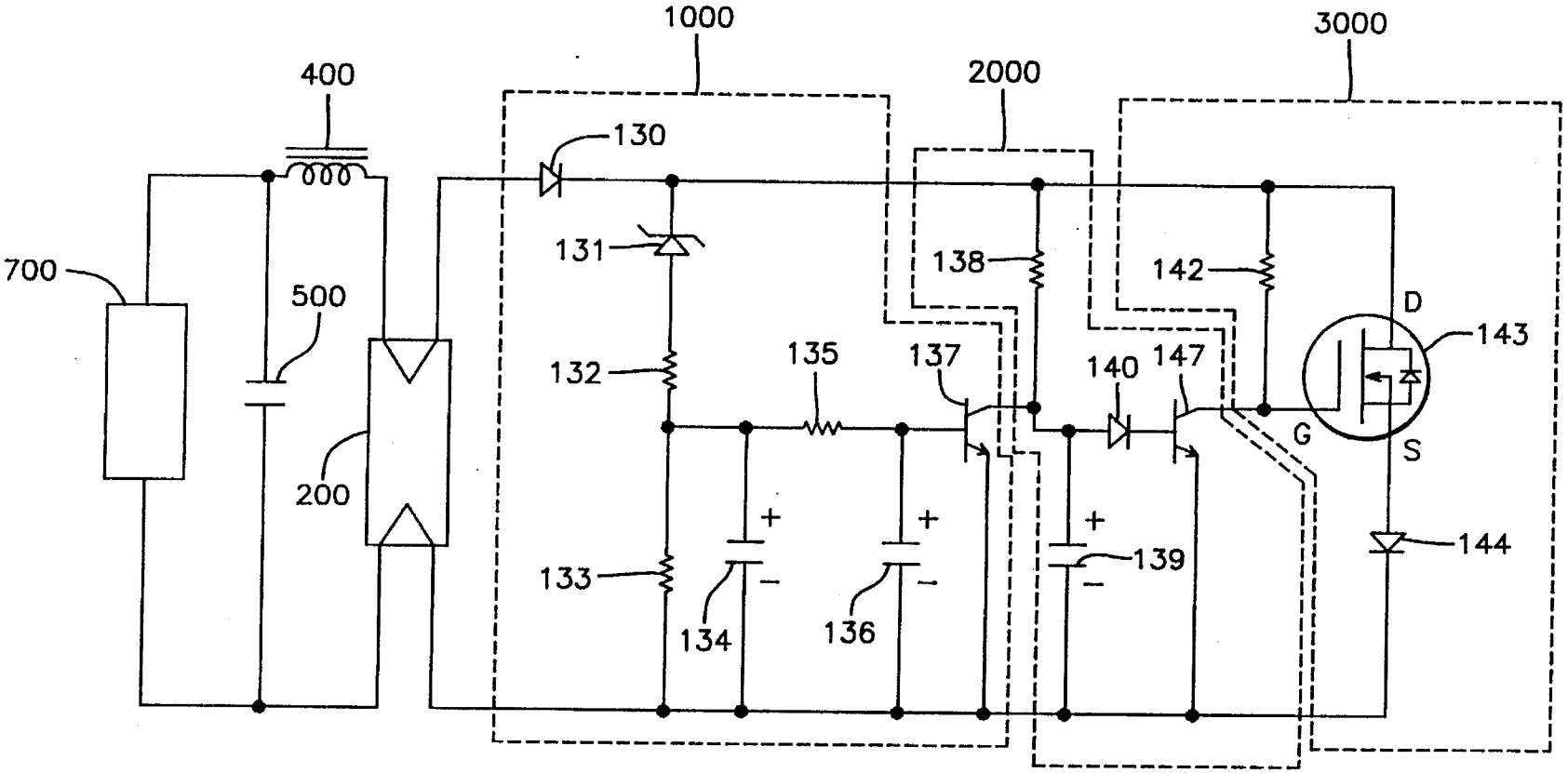
FIG. 12 is a circuit diagram of an electronic fluorescent starter incorporated with a POWER MOSFET master switch circuit according to the present invention.

FIG. 12 shows the electronic fluorescent starter incorporated with a POWER MOSFET master switch circuit. The circuit of FIG. 12 includes three parts, namely, the voltage reset circuit 1000, the ignition circuit 2000, and the master switch circuit 3000. When the tungsten filaments 201 and 202 of the fluorescent lamp 200 obtain a high voltage, the positive voltage at one end of the tungsten filaments is sent through the half wave rectifier 130 to the zener diode 131, then sent through the shunt resistors 132 and 133 to the opposite end of the tungsten filaments. The node between the shunt resistors 132 and 133 is connected to the input terminal of a $\pi$ type filter circuit, which consists of the first filter capacitor 134, the filter resistor 135 and the second filter capacitor 136. The half wave voltage from the zener diode 131 is turned to DC voltage by the π type filter circuit and then provided to the base of the transistor 137 to electrically connect its collector and emitter, causing the time constant capacitor 139 of the ignition circuit 200 to discharge. This process is the reset action. If the fluorescent lamp 200 is not turned on at this stage, the reset action will be continuously operated. Of course, it is to be understood that various equivalent filter circuits may be used instead of the aforesaid π type filter circuit. The ignition circuit 2000 consists of the time constant capacitor 139, the time constant resistor 138, the diode 140, and the transistor 141. When the positive half wave voltage is sent through the time constant resistor 138 to charge the time constant capacitor 139 and the voltage at the two opposite ends of the time constant capacitor 139 becomes higher than the saturation voltage at the base of the transistor 141 and the one-way diode 140, the POWER MOSFET of the master switch circuit 3000 ignites. The gate resistor 142 of the master switch circuit 3000 provides a positive half wave voltage to the POWER MOSFET 143 to heat the fluorescent lamp 200 when the transistor 141 is off. The diode 144 is connected to the source of the POWER MOSFET 143 to increase the sensitivity of the transistor 141. The half wave rectifier diode 130 may be replaced by a full wave rectifier as desired. In order to quickly turn on the fluorescent lamp 200, the time constant capacitor 139 and the first or second filter capacitor 134 or 136 may be eliminated from the circuit. IGBT may be used to replace the POWER MOSFET without affecting the aforesaid achievement.

While only few embodiments of the present invention have been shown and described, it will be understood that various modifications and changes could be made without departing from the spirit and scope of the invention.

What is claimed is:

1. A fluorescent device comprising an electronic fluorescent starter, a phase leading capacitor, a ballast, a bridge rectifier circuit, a fluorescent lamp, a brightness compensation circuit, and a control circuit, wherein said electronic fluorescent starter comprises a time control circuit, a master switch circuit, and an ignition circuit connected in parallel to two opposite ends of said fluorescent lamp and operated to control the ignition and heating operations of said fluorescent lamp, said time control circuit being directly coupled to said ignition circuit, the ON and OFF controls between said ignition circuit and said master switch circuit being operated through a direct coupling, an ignition time being synchronized with the peak value of a heating current, said time control circuit being directly coupled to a voltage reset circuit having a zener diode, and said time control circuit being controlled by the zener voltage of said zener diode.

2. A fluorescent device comprising an electronic fluorescent starter, a phase leading capacitor, a ballast, a bridge rectifier circuit, a fluorescent lamp, a brightness compensation circuit, and a control circuit, wherein said control circuit comprises a time constant resistor, a time constant capacitor and a voltage reset circuit, said voltage reset circuit comprising a transistor and two shunt resistors, said time constant resistor and said time constant capacitor being connected in series, a node between said time constant resistor and said time constant capacitor being connected to the collector of said transistor, the emitter of said transistor being connected to the negative terminal of the power supply, the base of said transistor being connected to a node between said shunt resisters, and P and N junctions of the zener diode being respectively connected to an A point positive voltage terminal and one end of said shunt resistors, the zener diode being connected in series to said shunt resistors, the transistor of said voltage reset circuit being a NPN type transistor.

3. A fluorescent device comprising an electronic fluorescent starter, a phase leading capacitor, a ballast, a bridge rectifier circuit, a fluorescent lamp, a brightness compensation circuit, and a control circuit, wherein said electronic fluorescent starter includes a master switch circuit which is a normally closed switch circuit comprising a darlington circuit having its base connected to a resistor and having a connection between the emitter of a transistor and a plurality of diodes, the two opposite ends of said darlington circuit being respectively connected to A and B connecting terminals of said fluorescent lamp, the forward voltage of the A connecting terminal of said fluorescent lamp being the saturation voltage of said darlington circuit plus the saturation voltage of the diodes.

4. A fluorescent device comprising an electronic fluorescent starter, a phase leading capacitor, a ballast, a bridge rectifier circuit, a fluorescent lamp, a brightness compensation circuit, and a control circuit, wherein said electronic fluorescent starter includes an ignition circuit comprising a diode, a zener diode, and a transistor, the collector of said transistor being directly coupled to the base of a darlington circuit of a master switch circuit of the electronic fluorescent starter, the emitter of said transistor being directly coupled to a negative terminal of a power supply, the base of said transistor being directly coupled to the N junction of said diode, the P junction of said diode being directly coupled to the P junction of said zener diode, the N junction of said zener diode being directly coupled to a node between a time constant resistor and a time constant capacitor.

5. A fluorescent device comprising an electronic fluorescent starter, a phase leading capacitor, a ballast, a bridge rectifier circuit, a fluorescent lamp, a brightness compensation circuit, and a control circuit, wherein said control circuit comprises a first OP AMP IC for determining if an AC voltage reaches a pre-set voltage value, the AC voltage being transmitted through a half wave rectifier diode to two shunt resistors, the voltage value of the first OP AMP IC being obtained from a node between said two shunt resistors, said node between said two shunt resistors being connected with a first filter capacitor, which turns AC voltage into DC voltage permitting DC voltage to be sent to the positive input terminal of said first OP AMP IC; the negative input terminal of said first OP AMP IC being directly coupled to a node between two other shunt resistors to obtain a reference voltage from the output terminal of a three-terminal voltage regulator, an output terminal of said three-terminal voltage regulator being directly coupled with a second filter capacitor; the output terminal of said first OP AMP IC being directly coupled with a voltage drop resistor and the input side of a photo thyristor coupler, said voltage drop resistor and said photo thyristor coupler being directly coupled in series; the positive and negative input terminals of a second OP AMP IC being indirectly connected to the output terminal of said three-terminal voltage regulator to obtain a power supply, the positive terminal of said second OP AMP IC obtaining a reference voltage from the node between an additional two shunt resistors electrically connected between the output terminal of said three-terminal voltage regulator and ground, the voltage at the negative input terminal of said second OP AMP IC being obtained from a resistor which is electrically connected between the negative input terminal of said second OP AMP IC and said output terminal of the three-terminal voltage regulator; the output side of said second OP AMP IC being directly coupled with a P junction of a diode, whose N-junction is connected to one end of two further shunt resistors, a node between said two further shunt resistors being connected to the gate of a silicon controlled rectifier, the positive terminal of said silicon controlled rectifier being connected to the positive input terminal of said first OP AMP IC and the negative terminal of said silicon controlled rectifier being connected to ground; the output side of the photo thyristor coupler which has an input connected to said first OP AMP IC being directly coupled to a node between an A terminal of said fluorescent starter and the collectors of a said darlington circuit; the input side of another photo coupler connected to the negative input terminal of said second OP AMP IC being directly coupled to two opposite ends of a time constant capacitor of said fluorescent lamp, said time constant capacitor being directly coupled in series to a voltage drop resistor.

6. A fluorescent device comprising an electronic fluorescent starter, a phase leading capacitor, a ballast, a bridge rectifier circuit, a fluorescent lamp, a brightness compensation circuit, and a control circuit, wherein the two AC terminals of said bridge rectifier circuit are connected to an output terminal of said ballast, the positive terminal of said bridge rectifier circuit being directly coupled to a first end of said fluorescent lamp, the negative terminal of said bridge rectifier circuit being directly coupled to a second end of said fluorescent lamp.

7. A fluorescent device comprising an electronic fluorescent starter, a phase leading capacitor, a ballast, a bridge rectifier circuit, a fluorescent lamp, a brightness compensation circuit, and a control circuit, wherein said brightness compensation circuit comprises a high voltage capacitor, a relay, and a voltage capacitor circuit comprising an OP AMP IC, said high voltage capacitor being a pulse voltage capacitor connected in series to the normally open contact point of said relay and then connected to the first and second terminals of said fluorescent lamp, the capacitance of said high voltage capacitor being dependent upon the desired intensity of light from said fluorescent lamp, said relay comprising at least one normally open contact point; said OP AMP IC of said voltage comparator circuit comprising an output terminal, a positive input terminal and a negative input terminal, the positive input terminal of said voltage comparator circuit being directly coupled to a node between two shunt resistors having one end connected to the output terminal of a three-terminal voltage regulator and an opposite end directly coupled ground, the negative terminal of said OP AMP IC of said voltage comparator circuit being directly coupled to a node between two other shunt resistors having one end directly coupled to the N junction of a half wave rectifier diode and an opposite end directly coupled to ground, the output terminal of said OP AMP IC of said voltage comparator circuit being directly coupled to one end of two additional shunt resistors, a node between said two additional shunt resistors being directly coupled to the base of a transistor and an opposite end of said two additional shunt resistors being directly coupled to ground, the collector and emitter of said transistor being respectively and directly coupled to a coil of said rely and ground.

8. A fluorescent device comprising an electronic fluorescent starter, a phase leading capacitor, a ballast, a fluorescent lamp, a brightness compensation circuit, and a control circuit, wherein said brightness compensation circuit includes a high voltage capacitor, one end of said high voltage capacitor being connected to one end of an output terminal of said ballast, an opposite end of said high voltage capacitor being connected to one end of a normally open contact of a relay, the opposite end of the normally open contact of said relay being connected to the opposite end of the output terminal of said ballast permitting said high voltage capacitor and the normally open contact of said relay to be connected into a series circuit having two opposite ends connected to the two ends of the output terminal of said ballast, the high voltage capacitor and the normally open contact of said relay being connected into a series circuit having two opposite ends connected to two opposite ends of said fluorescent lamp, said electronic fluorescent starter comprising a bridge rectifier.

9. A fluorescent device comprising an electronic fluorescent starter, a phase leading capacitor, a ballast, a bridge rectifier circuit, a fluorescent lamp, a brightness compensation circuit, and a control circuit, wherein the brightness compensation circuit comprises a time constant resistor, a time constant capacitor, a first zener diode, a base resistor, a transistor, a relay, a second zener diode, a filter capacitor, and a high voltage capacitor, said time constant resistor having one end directly coupled to a positive terminal of a power supply and an opposite end directly coupled to the positive terminal of said time constant capacitor and the N junction of said first zener diode, the negative terminal of said time constant capacitor being directly coupled to a negative terminal of the power supply, the P junction of said first zener diode being directly coupled to the base of said transistor and one end of said base resistor, the opposite end of said base resistor being directly coupled to the negative terminal of the power supply, the emitter of said transistor being directly coupled to the negative terminal of said power supply, the collector of said transistor being directly coupled to one end of a coil of said relay, the opposite end of the coil of said relay being directly coupled to the N junction of said second zener diode, the positive terminal of said filter capacitor and one end of a voltage drop resistor, the P junction of said second zener diode and the negative terminal of said filter capacitor being directly coupled to the negative terminal of said power supply, an opposite end of said voltage drop resistor being directly coupled to the positive terminal of the power supply, a normally open contact of said relay having one end directly coupled to one end of a tungsten filament of said fluorescent lamp and an opposite end directly coupled to one end of said high voltage capacitor, the opposite end of said high voltage capacitor being directly coupled to an opposite end of the tungsten filament of said fluorescent lamp.

10. A fluorescent brightness compensation device comprising a voltage reset circuit including shunt resistors, a zener diode and a transistor; a time constant resistor; a time constant capacitor; a brightness compensation circuit; and a mechanical fluorescent starter, said voltage reset circuit and said time constant resistor and said time constant capacitor being directly coupled together, said time constant resistor and said time constant capacitor and said brightness compensation circuit being directly coupled together, a contact of a relay of said brightness compensation circuit having one end directly coupled to one end of a tungsten filament of a fluorescent lamp, an opposite contact of said relay being directly coupled to one end of said high voltage capacitor, the opposite end of said high voltage capacitor being directly coupled to an opposite end of the tungsten filament of said fluorescent lamp, the mechanical fluorescent starter having one end directly coupled to said high voltage capacitor and an opposite end directly coupled to another opposite contact of said relay, said high voltage capacitor and said relay being connected in parallel when a coil of said relay is triggered, the contact of said relay being a C type contact, said mechanical fluorescent starter being connected through the contacts of said relay in parallel to the two opposite ends of the tungsten filaments of said fluorescent lamp during the heating and ignition process of said fluorescent lamp, said high voltage capacitor being connected through the contacts of said relay in parallel to the two opposite ends of the tungsten filaments after completion of the ignition process of said fluorescent lamp, said shunt resistors being connected into a series circuit having one end connected to the N junction of a half wave rectifier diode, a node between said shunt resistors being directly coupled to the N junction of said zener diode, and an opposite end of said shunt resistors directly coupled to the negative terminal of a power supply, the P junction of said zener diode being directly coupled to the base of the transistor of said voltage reset circuit.

11. An electronic fluorescent starter comprising a voltage reset circuit, an ignition circuit, and a master switch circuit, said ignition circuit comprising a time constant resistor, a time constant capacitor, a one-way diode and a first transistor, said master switch circuit comprising a gate resistor, a POWER MOSFET or IGBT and a diode, said voltage reset circuit comprising a zener diode, a shunt circuit formed of two resistors, a $\pi$ type filter circuit, and a second transistor, said zener diode being connected in series to said resistors of the shunt circuit, the output terminal of said $\pi$ type filter circuit being connected across the base and emitter of said second transistor, the collector of said second transistor being directly coupled to a node between the time constant resistor and the time constant capacitor of said ignition circuit, said time constant resistor and said time constant capacitor being connected in series so that said node between said time constant capacitor and said time a constant resistor is coupled to the collector of said second transistor and the P junction of said one-way diode, the N junction of said one-way diode being directly coupled to the base of said first transistor, the emitter of said first transistor being directly coupled to the negative terminal of a power supply, the collector of said first transistor being directly coupled to the gate of the POWER MOSFET of said master switch circuit, one end of said gate resistor and the drain of said POWER MOSFET being directly coupled to a positive terminal of said power supply, the opposite end of said gate resistor being directly coupled to the gate terminal of said POWER MOSFET and the collector of the first transistor, the source of said POWER MOSFET being directly coupled to the P junction of said diode of the master switch circuit, the N junction of said diode of the master switch circuit being directly coupled to the negative terminal of the power supply, the $\pi$ type filter circuit being arranged so as to convert rectified AC power into a DC power supply.

* * * * *

UNITED STATES PATENT AND TRADEMARK OFFICE

CERTIFICATE OF CORRECTION

PATENT NO. : 5,583,395

DATED : December 10, 1996

INVENTOR(S) : Chao-Cheng Lu

It is certified that error appears in the above-identified patent and that said Letters Patent is hereby corrected as shown below:

In the drawings, Sheet 1, Figure 3, the illustrated transistor 115 should have an arrow pointing outwardly therefrom at the lower-most terminal of the transistor 115, and the inwardly pointing arrow on transistor 115 should be changed to a line.

Signed and Sealed this

Twenty-second Day of April, 1997

Bruce Lehman

*Attest:*

BRUCE LEHMAN

*Commissioner of Patents and Trademarks*

*Attesting Officer*